US005308654A

United States Patent [19]

Nagae et al.

[11] Patent Number: 5,308,654

[45] Date of Patent: May 3, 1994

[54] METHOD FOR LUBRICATING STEEL TUBING PRIOR TO COLD DRAWING

[75] Inventors: Yoshio Nagae, Osaka; Koji Kaburagi; Koji Hetsugi, Kanagawa, all of Japan

[73] Assignee: Henkel Corporation, Plymouth Meeting, Pa.

[21] Appl. No.: 952,746

[22] PCT Filed: May 29, 1991

[86] PCT No.: PCT/US91/03737

§ 371 Date: Nov. 30, 1992

§ 102(e) Date: Nov. 30, 1992

[30] Foreign Application Priority Data

May 30, 1990 [JP] Japan ..... 2-138590

[51] Int. Cl.[5] ..... B05D 7/22

[52] U.S. Cl. ..... 427/239; 252/25; 252/34.7; 252/46.6; 252/48.6; 427/327; 427/384; 427/388.1; 427/409

[58] Field of Search ..... 252/24, 32.7 R, 32.7 E, 252/32.7 HL, 25, 34.7, 46.6, 48.6; 427/239, 327, 384, 388.1, 409

[56] References Cited

U.S. PATENT DOCUMENTS 3,258,319 6/1966 Cox ..... 427/327 X
3,481,762 12/1969 Streicher ..... 427/384 X
4,287,741 9/1981 Peters et al. ..... 427/388.1 X

FOREIGN PATENT DOCUMENTS 63-021597 1/1988 Japan .
63-238921 10/1988 Japan .

*Primary Examiner*—Michael Lusignan
*Attorney, Agent, or Firm*—Ernest G. Szoke; Wayne C. Jaeschke; Norvell E. Wisdom, Jr.

[57] ABSTRACT

In the cold drawing of steel tubing, an excellent lubrication which permits drawing the tubing while retaining its original metallic luster can be achieved by first contacting the surfaces of the tubing, both exterior and interior, with a colloidal titanium containing aqueous composition, drying the tubing, and then applying to the surface of the tubing a liquid lubricating composition comprising (i) from 40 to 95% of a first component selected from the group consisting of olefin/oil or olefin/fat compounds which contain from 23 to 30% of sulfur and olefin/higher ester compounds which contain from 23 to 30% sulfur, including mixtures of two or more chemical species meeting this description; and (ii) from 5 to 50% of a second component selected from the group consisting of oil soluble polymer compounds, fats and oils, synthetic oils, mineral oils, higher fatty acids, and the amine salts of higher fatty acids.

16 Claims, No Drawings

METHOD FOR LUBRICATING STEEL TUBING PRIOR TO COLD DRAWING

TECHNICAL FIELD

The present invention relates to a lubrication treatment method which is especially well adapted for the production of smooth steel tubing with a metallic luster by the cold drawing of carbon steel tubing, for example, pickled steel tubing, bright annealed tubing, and seam welded tubing.

BACKGROUND ART

A pretreatment widely employed prior to the cold drawing of carbon steel tubing consists of the formation of a phosphate conversion film on the surface of the steel tubing followed by the formation of a lubricating film on the phosphate conversion film through the application of, inter alia, a metal soap solution. A problem associated with this technique is that a portion of the phosphate and metal soap adheres as scale on the surface of the steel tubing after the cold-drawing operation, and this serves to diminish the steel tubing's metallic luster.

According to Japanese Patent Application Laid Open [Kokai or Unexamined] Number 63-215797 [215,797/88], drawn steel tubing with an excellent metallic luster is obtained after a facile pretreatment by avoiding the use of a phosphate conversion treatment and metal soaps. Japanese Patent Application Laid Open Number 63-238921 [238,921/88] provides for the production of steel wire with an excellent metallic luster, although this art is not principally intended for the manufacture of steel tubing. However, further improvement is still desired with regard to such factors as the cross section reduction ratio and seizure resistance of tubing during cold drawing.

DESCRIPTION OF THE INVENTION

Problem to Be Solved by the Invention

It is desired that the pretreatment used for steel tubing in a cold drawing operation be characterized by little seizure at the die, plug, etc., even for cold drawing at high cross section reduction ratios. The present invention thus takes as its object the introduction of a lubrication treatment method for steel tubing which not only supports the production of drawn steel tubing with an excellent metallic luster, but which also is associated with less seizure at the die or plug than in Japanese Patent Application Laid Open Numbers 63-215797 and 63-23892 1, even for cold drawing at high cross section reduction ratios.

SUMMARY OF THE INVENTION

The present invention comprises a method for the lubricating treatment of steel tubing, said method being characterized by contacting carbon steel tubing, prior to its cold drawing, with a colloidal titanium containing liquid composition which has a pH of 8 to 11 and which contains from 0.001 to 0.5 grams per liter ("g/L"), measured as titanium, of a colloidal titanium containing material formed as the product of reaction in solution between a water soluble titanium containing compound and a water soluble alkaline phosphate, thereafter drying the carbon steel tubing, and then applying a liquid lubricating composition on the surface of the carbon steel tubing thus treated, wherein said liquid lubricating composition has a viscosity at 20° C. in the range from 100 to 3,000 centipoises and comprises, or preferably consists essentially of:

(A) from 40 to 95% (all percent numbers here and below being percents by weight) of a first component selected from the group consisting of olefin/oil or olefin/fat compounds which contain from 23 to 30% of sulfur and olefin/higher ester compounds which contain from 23 to 30% sulfur, including mixtures of two or more chemical species meeting this description; and (B) from 5 to 50% of a second component selected from the group consisting of oil soluble polymer compounds, fats and oils, synthetic oils, mineral oils, higher fatty acids, and the amine salts of higher fatty acids; and, optionally, (C) a phosphorus containing extreme pressure additive;

(D) dispersed solid lubricant; and (E) surfactants.

DETAILS OF PREFERRED EMBODIMENTS OF THE INVENTION

The colloidal titanium containing liquid composition used in the present invention may be and preferably is the same type of composition as is used in the prior art for "activating" active metal surfaces before phosphate conversion coating these surfaces. The titanium containing compound and alkaline phosphate used for preparation of the present invention's colloidal titanium liquid composition must be selected so that colloidal titanium will be formed as their reaction product. Suitable titanium containing compound are exemplified by the oxyacid salts of titanium such as titanyl sulfate ($TiSO_4$), titanyl nitrate, and the like, but titanyl sulfate is particularly preferred. The alkaline phosphate is preferably a dibasic alkali metal phosphate, such as dibasic sodium phosphate, but condensed phosphates such as sodium pyrophosphate can also be used. The colloidal titanium concentration must be 0.001 to 0.5 g/L as titanium and is preferably 0.01 to 0.5 g/L as titanium, and the concentration of the reaction product should be adjusted so as to afford such a concentration. The pH of the colloidal titanium containing liquid composition can be adjusted to 8 to 11 by the addition of alkali metal carbonate, alkali metal hydroxide, or alkali metal phosphate, as exemplified by sodium carbonate, sodium hydroxide, dibasic sodium phosphate, and tribasic sodium phosphate. A pH of 9 to 10 is even more preferred.

The steel tubing should usually be immersed in the colloidal titanium containing liquid composition at from room temperature to approximately 80° C. for approximately 2 to 3 minutes with suitable agitation by stirring or circulation of the composition. The method for contacting the colloidal Ti containing liquid composition with the steel tubing is not necessarily restricted, and immersion is cited above by way of example. When the steel tubing is relatively short, flow or spray methods can be used equally well, so long as the interior surface of the steel tubing is completely wetted.

In the case of pickled steel tubing, the work should be thoroughly washed with water after pickling and then transferred into the colloidal titanium containing liquid composition, and it is crucial in this case that the pH of the colloidal titanium containing liquid composition be maintained at or above 8. In order to facilitate drying by the steel tubing after its immersion in the colloidal titanium containing liquid composition, it is advantageous to heat this liquid composition to 50° to 80° C.

When the content of colloidal titanium falls below 0.001 g/L as titanium, less titanium than is desirable is adsorbed onto the surface of the steel tubing, and the improvement in lubricity is therefore usually inadequate and a satisfactory lubrication performance will not usually be achieved. The adsorption becomes saturated at concentrations in excess of 0.5 g/L, which precludes further increase in performance in correspondence to the incremental additions above this value. The dispersibility of the titanium colloid declines at pH values below 8, and this compromises the titanium's capacity for adsorption onto the surface of the steel tubing. However, this adsorbability is not further increased by increases in the pH beyond pH 11.

Any oil adhered on the surface of the steel tubing should be removed in advance by, for example, an alkali wash. Non-oily steel tubing can be immersed in the colloidal titanium containing liquid composition without an alkali wash. The wettability of the steel tubing can be improved, for example, through the addition to the colloidal Ti containing liquid composition of not more than 0.3 g/L of nonionic surfactant.

An extremely thin mixed film of alkaline phosphate and titanium compound, presumably $Ti(OH)PO_4$, is believed to be deposited on the exterior and interior surfaces of the steel tubing by contacting these surfaces of the steel tubing with the colloidal Ti containing liquid composition as in the preceding description and subsequently draining and drying. After film formation, the steel tubing is then cooled more or less to room temperature, and its interior and exterior surfaces are coated at ambient temperature with the liquid lubricating composition as herein specified.

The constituent components of the liquid lubricating composition (which may also for brevity, particularly in the tables herein, be called "lubricating oil") that is required for the present invention will now be considered in greater detail.

An olefin/oil or olefin/fat compound which contains 23 to 30% sulfur can be prepared, for example, by a reaction for 3 hours at 150° to 160° C. between 1 mole of unsaturated plant or animal oil or fat with sulfur and 1 mole of olefin based mercaptan compound in the presence of a basic catalyst such as di-n-butylamine. With increasing preference, the unsaturated oil or fat used in this reaction will have at least one carbon-carbon double bond in at least 50%, at least 75%, or at least 90% of the fatty acid derived acyl groups in the oil or fat. Also, independently, it is preferred that the amount of sulfur used in this reaction be such as to provide at least one atom of sulfur for each carbon-carbon double bond in the molecules of the oil or fat used.

The reaction as described in the paragraph immediately above is followed by distillation in vacuo to remove unreacted material and aeration at 80° C. to remove hydrogen sulfide.

An olefin/higher ester compound which contains 23 to 30% sulfur can be prepared by the same general method as described above for olefin/oil or fat compounds containing sulfur, except that a monoester of an unsaturated fatty acid and an unsaturated fatty alcohol is substituted for the triglyceride ester in a vegetable or animal oil or fat. Each of the alcohol and acid molecules used to form the ester(s) used preferably has at least 12 and not more than 22 carbon atoms. It is again preferred that the amount of sulfur used in this reaction be such as to provide at least one atom of sulfur for each carbon-carbon double bond in the molecules of the amount of ester used, and that the number of sulfur atoms in the sulfur chains formed in the product not exceed six. For example, a suitable compound can be made by mixing 1 mole of oleyl oleate ester with sulfur and 1 mole of olefin-based mercaptan compound and processing as above in the presence of a basic catalyst.

The liquid lubricating composition should contain 40 to 95% of at least one compound selected from among the aforesaid types of sulfur containing compounds. This blending proportion should be determined so as to obtain the maximum or desired level of lubrication performance.

The aforesaid sulfur containing compounds contain short "chains" of sulfur atoms which may be represented chemically as $(—S—)_n$, where n represents an integer. The value of n should be at most 6. The extreme pressure properties of these compounds are in fact better as the sulfur content increases; however, the oiliness suffers from a decline due to the smaller number of bonded carbon atoms (from the olefin and the fatty acid residues in the fatty acid triglycerides) relative to the quantity of sulfur. Accordingly, the optimum range for sulfur bonding must be determined according to the nature of the organic compounds by considering both the extreme pressure properties and the oiliness which are to be imparted to the liquid lubricating composition.

In the present invention, the sulfur content in the above described sulfur containing compounds (a) and (b) should be 23 to 30%. The extreme-pressure performance declines at less than 23%, and seizure will tend to occur when the steel tubing is drawn. These compounds are unstable at above 30%, and the sulfur may precipitate. It has been confirmed that sulfur contents of 25 to 29% in these compounds yield particularly good lubricating properties.

Because this oil's lubricating performance is also affected by its viscosity, the viscosity at 20° C. must fall into the range of 100 to 3,000 centipoise. When the mixed oil would otherwise have a low viscosity, the viscosity may be raised to a suitable value by the additional admixture of 5 to 50 weight % of an oil soluble polymer thickener, fat or oil, synthetic oil, higher fatty acid, or amine salt of a higher fatty acid. When the viscosity of the mixed oil would otherwise be too high, the viscosity can be lowered to the desired value by the admixture of 5 to 50 weight % low-viscosity synthetic oil or low-viscosity mineral oil. Preferably none of the constituents mentioned in this paragraph contains sulfur.

Suitable oil-soluble polymers are exemplified by polyisobutylenes with average molecular weights of approximately 5,000 to 300,000, olefinic copolymers (ethylene-propylene-butylene types) with average molecular weights of 10,000 to 1,000,000, and polymethacrylates with average molecular weights of 20,000 to 1,500,000. The polymethacrylates are preferred among these. Preferable polymethacrylates comprise at least one selection from among polymers conforming to one of the following general formulas:

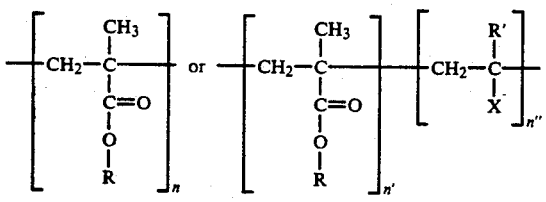

wherein R is $C_9$ to $C_{16}$ alkyl, R' is H or $CH_3$, X is a polar group, and each of n, n', and n'' independently is a positive integer. The polar monomer unit including the "X" in the above structural formula is exemplified by the residues after polymerization of unsaturated amines such as diethylaminoethyl methacrylate and 2-methyl-5-vinylpyridine, unsaturated amides such as N-vinylpyrrolidinone, and unsaturated acids or cyclic anhydrides such as maleic anhydride, or by polyalkylene glycol esters.

Suitable natural fats and oils are exemplified by rapeseed oil, lard oil, coconut oil, castor oil, beef tallow, and the like. Suitable synthetic oils are exemplified by dioctyl sebacate, pentaerythritol derivatives, and the like.

Suitable mineral oils are exemplified by machine oil. Suitable higher fatty acids are exemplified by the animal and plant fatty acids and synthetic fatty acids, and, in specific terms, by caprylic acid, capric acid, lauric acid, myristic acid, palmitic acid, stearic acid, oleic acid, linoleic acid, and the like. Suitable amine salts of higher fatty acids are exemplified by the $C_{12}$ to $C_{22}$ primary amine salts, and oleylamine is particularly preferred.

As necessary or desired, a phosphorus containing extreme pressure additive may also be blended into the liquid lubricating composition according to the present invention in order to improve the severe cold drawability. These phosphorus containing extreme pressure additives may be generally classified into phosphate esters and phosphite esters, from which the additive under consideration may be selected without restriction. This additive, when used, is generally blended at 1 to 20% of the total liquid lubricating composition. Suitable additives of the phosphate type are exemplified by tricresyl phosphate, tri-n-amyl phosphate, tri-n-butyl phosphate, diphenylcresyl phosphate, and the like; additives of the phosphite type are exemplified by tri-n-butyl phosphite, tri-n-octyl phosphite, tri-n-decyl phosphite, triisodecyl phosphite, triphenyl phosphite, diphenyldecyl phosphite, and tricresyl phosphite.

As an optional component other than the preceding components, a solid lubricant can be added to the liquid lubricating composition of the present invention. These are exemplified by powders selected from talc, graphite, boron nitride, molybdenum disulfide, calcium carbonate, and the like. These exercise a so-called spacer function, which acts to reinforce the inhibition of seizing which could occur due to contact between the steel and the drawing tool in severe, high force cold drawing operations. The addition of such solid lubricants makes possible even more severe high force cold drawing.

As another optional component, a suitable quantity of a surfactant may be blended into the liquid lubricating composition according to the present invention. This improves the removability (by washing) of the oil film remaining on the surface of the cold-drawn steel.

Although the invention is not limited by any theory, the following may explain the beneficial effects obtained by the invention: An extremely thin titanium compound film is likely to be formed on the clean surface of the steel tubing in the first step. This film would be strongly bonded to the steel surface due to the strong adsorption qualities characteristic of colloidal titanium. It therefore could function as a base coat for the liquid lubricating composition and improve its lubricating performance. The liquid lubricating composition according to the present invention, which contains the herein specified sulfur containing compounds, is probably decomposed by the heat evolved during the pulling-/elongation process, and this probably generates a highly reactive form of sulfur which reacts with the iron on the surface of the steel tubing to form a film of FeS, $Fe_2S$, or the like. The phosphorus containing extreme pressure additive probably is also decomposed by the heat to form a film of FeP-type compounds. This and the titanium compound based film then would effectively function to reinforce the lubricating performance of the oil film and inhibit seizing. An ideal extreme pressure performance and oiliness are brought together in the liquid lubricating composition specified by the present invention, and as a result the oil film evidences a superior lubrication performance. Thus, even in the absence of a zinc phosphate film undercoat, the following excellent functional effects are manifested: Severe cold drawing processes are possible, the yield from pulling/elongation is increased, and steel tubing which displays a metallic luster is obtained.

Examples of the present invention as well as comparison examples are given below in order to illustrate the effects of the invention in concrete terms.

EXAMPLES

Annealed seamless carbon-steal tubing (with a carbon content=0.1%, diameter=50.0 mm, thickness=5.5 mm) was contacted with a colloidal titanium-containing liquid composition by performing process steps in the order shown in Table 1. The treatment with colloidal titanium referenced in Table 1 was with an aqueous based liquid composition containing (before reaction) 0.2 g/L (as titanium) of titanyl sulfate and 14.0 g/L of disodium phosphate. It was used at a pH of 8.5 and a temperature of 60° to 70° C. After pretreatment as described in Table 1, the steel tubing was coated with liquid lubricating composition 1, 2, or 3 as specified in the columns in Table 2 for liquid lubricating compositions according to the present invention.

TABLE 1

PRETREATMENT CONDITIONS

| Step Name | Process Conditions |
|---|---|
| Pickling | immersion in inhibited 10% aqueous $H_2SO_4$ for 20 minutes at 50° C. |
| Water wash | immersion, room temperature, 30 seconds |
| Water wash | same as above |
| Colloidal titanium treatment | immersion, 60 seconds, 60° C. |
| Drying | hot-air drying |

TABLE 2

| | classification: lubricating oils according to the invention number: | | |
|---|---|---|---|
| | 1 | 2 | 3 |
| base oil | | | |
| rapeseed oil | 20 | | |
| oleic acid | | 10 | 5 |

TABLE 2-continued

| | | | |
|---|---|---|---|
| machine oil | | | 5 |
| sulfurized fats and oils from the prior art | | | |
| oleic acid/oleyl alcohol compound containing 15 wt % sulfur | | | |
| compound of rapeseed oil containing 15 wt % sulfur | | | |
| sulfur-bonding compounds containing at least 23 wt % S | | | |
| rapeseed oil/olefin ($C_9$) compound containing 30 wt % sulfur | 70 | | 30 |
| compound of olefin ($C_9$) and oleic acid-oleyl alcohol ester containing 28 wt % sulfur | | 80 | 30 |
| P-based EP additive | | | |
| tricresyl phosphate | | | 20 |
| thickener | | | |
| Aclube 702 (see note 1) | 10 | | 10 |
| Polybudene 30 N (see note 2) | | 10 | |
| sulfur fraction in the lubricating oil composition (weight %) | 21.0 | 22.4 | 17.4 |
| viscosity (centipoise) at 20° C. | 1450 | 380 | 1340 |

| | classification: comparison lubricating oils number: | | |
|---|---|---|---|
| | 4 | 5 | 6 |
| base oil | | | |
| rapeseed oil | | 20 | |
| oleic acid | 10 | | 5 |
| machine oil | | | 5 |
| sulfurized fats and oils from the prior art | | | |
| oleic acid/oleyl alcohol compound containing 15 wt % sulfur | 80 | 40 | |
| compound of rapeseed oil containing 15 wt % sulfur | | | 60 |
| sulfur-bonding compounds containing at least 23 wt % S | | | |
| rapeseed oil/olefin ($C_9$) compound containing 30 wt % sulfur | | 30 | |
| compound of olefin ($C_9$) and oleic acid-oleyl alcohol ester containing 28 wt % sulfur | | | |
| P-based EP additive | | | |
| tricresyl phosphate | | | 20 |
| thickener | | | |
| Aclube 702 (see note 1) | | 10 | 10 |
| Polybudene 30 N (see note 2) | 10 | | |
| sulfur fraction in the lubricating oil composition (weight %) | 12.0 | 15.0 | 12.0 |
| viscosity (centipoise) at 20° C. | 1220 | 360 | 3770 |

The values given in the table for the components of the lubricating oils are in weight %.
note 1:
Aclube 702 = polymethacrylic thickener from Sanyo Chemical Industries, Ltd.
note 2:
Polybudene 30 N = polyisobutylene thickener from Nippon Oil and Fat Co., Ltd.

The sulfur-bonding compounds containing at least 23 wt % S shown in Table 2 as used in the compositions according to the invention were obtained commercially from Dainippon Ink & Chemicals, Inc. under the trade name DIC TM S3.

After coating with the liquid lubricating composition, the steel tubing was cold drawn under the conditions reported in Table 3, and the results from cold drawing are reported in Table 4 in the rows for the examples.

In Comparison Examples 4 to 6, pretreatment with colloidal titanium was conducted as in Table 1 and cold drawing was conducted as in Table 3, but liquid lubricating compositions from the prior art were used as reported in Table 2 in the comparison liquid lubricating composition columns 4, 5, and 6.

Comparison Examples 11 through 13 differed from the present invention in that pretreatment consisted of immersion for 30 seconds in 1% aqueous NaOH at 60° C. in place of the colloidal titanium pretreatment specified by Table 1.

Otherwise, the lubricating agents in Comparison Examples 11 through 13 were, respectively, 1, 2, and 3 as specified in Table 2 and used in Examples 1,2, and 3. Cold drawing was conducted in Comparison Examples 11, 12, and 13 according to Table 3.

As demonstrated by Table 4, when 100 seamless steel tubes were tested in the cold drawing operation, the % die seizure in the examples was 0 to 1%, while plug seizure was entirely absent in the examples. In contrast to this, seizure occurred often in the comparison examples (die seizure=4 to 24%, plug seizure=1 to 6%), which necessitated interruption of the process after 50 workpieces.

Thus, all of the examples gave excellent results for the cold-drawing operation. In addition, all of the steel tubes drawn in the examples according to the present invention had an excellent metallic luster.

TABLE 3

| Conditions in the cold drawing operation | |
|---|---|
| drawing tools | semifloating dies and semifloating plugs |
| degree of cold working | 41.2% (cross section reduction) |
| drawing velocity | 35 m/minute |
| steel tubing dimensions after the operation | diameter = 40.0 mm, thickness = 4.0 mm |

TABLE 4

Results from cold drawing of seamless steel tubing

| | lubricating oil | number drawn | number of die seizures | number of plug seizures |
|---|---|---|---|---|
| Examples | | | | |
| 1 | No. 1 | 100 | 1 | 0 |
| 2 | No. 2 | 100 | 1 | 0 |
| 3 | No. 3 | 100 | 0 | 0 |
| Comparison Examples | | | | |
| 4 | No. 4 | 50 | 12 | 4 |
| 5 | No. 5 | 50 | 8 | 3 |
| 6 | No. 6 | 50 | 10 | 6 |
| 11 | No. 1 | 50 | 3 | 1 |
| 12 | No. 2 | 50 | 3 | 1 |
| 13 | No. 3 | 50 | 2 | 1 |

BENEFITS OF THE INVENTION

As explained hereinbefore, the present invention imparts an excellent lubricity to the surface of steel, and this lubrication is in fact optimized for cold drawing operations. It also develops the following effects:

(a) after drawing, the surface is smooth and has a metallic luster;

(b) it does not require the multistep operations as encountered in conversion treatment and soap lubrication treatments, which supports simplification of the process equipment and energy savings;

(c) seizure at the die, plug, etc., occurs less frequently, which prolongs tool life and makes possible a more precise drawing operation.

The invention claimed is:

1. A method for the lubrication treatment of carbon steel tubing prior to cold drawing, said method comprising steps of:

(A) contacting the exterior and interior surface of the tubing with a colloidal titanium containing liquid composition which has a pH in the range from 8 to 11 and which contains from 0.001 to 0.5 g/l, measured as titanium, of a colloidal titanium containing material formed as the product of reaction in aqueous solution of a water soluble titanium containing compound and a water soluble alkaline phosphate;

(B) thereafter drying the tubing; and (C) subsequently applying to the thus treated exterior and interior surface of the dried tubing a liquid lubricating composition that has a viscosity at 20° C. in the range from 100 to 3,000 centipoises and that consists of:

(i) from 40 to 95% by weight of a first component selected from the group consisting of olefin/oil or olefin/fat compounds which contain from 23 to 30% by weight of sulfur and olefin/ester compounds which have 12-22 C atoms in the acid or alcohol residue and which contain from 23 to 30% by weight of sulfur, including mixtures of two or more chemical species meeting this description; and (ii) from 5 to 50% by weight of a second component selected from the group consisting of oil soluble polymer compounds, fats and oils, synthetic oils, mineral oils, $C_{12}$-$C_{22}$ fatty acids, and the amine salts of $C_{12}$-$C_{22}$ fatty acids; and, optionally, (iii) a phosporus containing extreme pressure additive component;

(iv) dispersed solid lubricant; and (v) surfactants.

2. A process according to claim 1, wherein the liquid lubricating composition used in step (C) contains from 1-20 by weight of a phosphorus containing extreme pressure additive component.

3. A process according to claim 2, wherein the colloidal titanium containing liquid composition used in step (A) contains from 0.01 to 0.5 g/l, measured as titanium, of colloidal titanium containing material.

4. A process according to claim 1, wherein the colloidal titanium containing liquid composition used in step (A) contains from 0.01 to 0.5 g/l, measured as titanium, of colloidal titanium containing material.

5. A process according to claim 4, wherein the colloidal titanium containing liquid composition used in step (A) has a pH in the range from 9-10.

6. A process according to claim 3, wherein the colloidal titanium containing liquid composition used in step (A) has a pH in the range from 9-10.

7. A process according to claim 2, wherein the colloidal titanium containing liquid composition used in step (A) has a pH in the range from 9-10.

8. A process according to claim 1, wherein the colloidal titanium containing liquid composition used in step (A) has a pH in the range from 9-10.

9. A process according to claim 8, wherein the first component of the liquid lubricating composition used in step (C) contains from 25 to 29% of sulfur.

10. A process according to claim 7, wherein the first component of the liquid lubricating composition used in step (C) contains from 25 to 29% of sulfur.

11. A process according to claim 6, wherein the first component of the liquid lubricating composition used in step (C) contains from 25 to 29% of sulfur.

12. A process according to claim 5, wherein the first component of the liquid lubricating composition used in step (C) contains from 25 to 29% of sulfur.

13. A process according to claim 4, wherein the first component of the liquid lubricating composition used in step (C) contains from 25 to 29% of sulfur.

14. A process according to claim 3, wherein the first component of the liquid lubricating composition used in step (C) contains from 25 to 29% of sulfur.

15. A process according to claim 2, wherein the first component of the liquid lubricating composition used in step (C) contains from 25 to 29% of sulfur.

16. A process according to claim 1, wherein the first component of the liquid lubricating composition used in step (C) contains from 25 to 29% of sulfur.

* * * * *